US005457918A

United States Patent [19]

Plourde

[11] Patent Number: 5,457,918

[45] Date of Patent: Oct. 17, 1995

[54] ANCHORING DEVICE FOR UMBRELLAS

[76] Inventor: Bernard Plourde, 32 rang Saint-Francois, Lanoraie, Québec, Canada, J0K 1E0

[21] Appl. No.: 398,739

[22] Filed: Mar. 6, 1995

[51] Int. Cl.[6] ..... A45F 3/44; A45B 25/00; E02D 5/74

[52] U.S. Cl. ..... 52/165; 52/157; 248/545

[58] Field of Search ..... 52/165, 157, 155; 248/545, 530, 558, 156

[56] References Cited

U.S. PATENT DOCUMENTS

| | | | |
|---|---|---|---|
| 2,209,504 | 7/1940 | Beiter | 52/157 X |
| 2,211,283 | 8/1940 | Mercer | 52/165 X |
| 2,554,887 | 5/1951 | Tricarico | 52/165 X |
| 4,738,062 | 4/1988 | Dickey | 52/157 |
| 4,832,304 | 5/1989 | Morgulis | 52/157 X |
| 5,046,699 | 9/1991 | Perreault et al. | 52/157 X |

*Primary Examiner*—Carl D. Friedman
*Assistant Examiner*—Robert J. Canfield

[57] ABSTRACT

An anchoring device for anchoring a post into a ground surface made of granular material. The anchoring device is particularly well adapted to anchor a beach umbrella into the sand. The anchoring device has a sleeve section and an integrally extending insertion section. The sleeve section defines a post receiving channel adapted to receive the post. The insertion section has a conically tapering configuration. A pair of parallel insertion threads extends integrally from the outer surface of the insertion section and a portion of the sleeve section. The parallel threads facilitate the insertion into the sand and further stabilize the device. A locking sleeve extends integrally from the sleeve section adjacent its top end. The locking sleeve defines a threaded locking channel that emerges into the post receiving channel. A handle sleeve also extends integrally from the sleeve section. The handle sleeve is diametrically opposed to the locking sleeve. The handle sleeve defines a handle channel that also emerges into the post receiving channel. A locking-handle component having an "L"-shaped configuration and a threaded end section are adapted to be slidably inserted into the handle sleeve channel and threadably inserted into the locking channel for respectively acting as a handle and releasably locking the post into the post receiving channel.

7 Claims, 3 Drawing Sheets

ANCHORING DEVICE FOR UMBRELLAS

BACKGROUND - FIELD OF THE INVENTION

The present invention relates to the field of devices for anchoring articles into the ground and is particularly concerned with an anchoring device for anchoring a beach umbrella into a ground surface.

BACKGROUND - PRIOR ART

Beach umbrellas are typically used to provide shading areas on sunny beaches. The conventional beach umbrella includes a canopy mounted on a set of ribs that are attached to the upper end section of an umbrella post. A ring is slidably mounted on the post. Spreaders are individually and pivotally attached at one of their ends to the ring and at their other end to a corresponding rib. The canopy is adapted to be moved between an open position wherein it provides shading and a closed position wherein it facilitates handling and storage. The lower end section of the conventional umbrella post typically has a substantially pointed general configuration that facilitates the anchoring of the umbrella into the ground as will be hereinafter disclosed.

The beach umbrella is usually carried and anchored to appropriate location by the user. The beach umbrella is typically anchored into a ground surface which consists of granular material such as sand or the like. To anchor a conventional beach umbrella into the ground, the user typically pushes the pointed lower section of the umbrella pole into the ground. The pressure of the ground on the outer surface of the submerged lower section provides lateral support for the umbrella.

The conventional beach umbrella has proven to be unsatisfactory in situations wherein a firm lateral support is required as for example when the beach umbrella is subject to adverse environmental elements such as wind. Also, the support provided by the conventional beach umbrellas anchoring post, has proven to be unsatisfactory when the ground into which it is anchored is particularly friable.

Furthermore, users anchoring the conventional beach umbrella into the ground must sometimes use a considerable amount of force to insert the pointed lower section into the ground.

Accordingly, various attempts have been made to circumvent the above mentioned disadvantages by providing an anchoring structure that includes a thread-like component positioned adjacent the lower end of the anchoring post. The threadlike component increases the lateral support of the ground on the post and facilitates the insertion of the post into the ground.

Examples of prior art anchoring devices using threadlike components include U.S. Pat. No. 2,211,283 issued to David Laughlin Mercer on Aug. 13, 1940, U.S. Pat. No. 2,168,830 issued to J. B. Schroth on Aug. 8, 1939, and U.S. Pat. No. 2,643,834 issued to D. Brown on Jun. 30, 1953. Although the hereinabove mentioned patents disclose structures that represent an improvement over the conventional pointed tip umbrella posts, these structures nevertheless suffer from a set of drawbacks.

Firstly, these structures are relatively complex and thus relatively expensive to manufacture. Secondly, the structures have proven to be unergonomical in use and have also proven to be inefficient in providing adequate lateral support for the umbrella.

SUMMARY OF THE INVENTION

Accordingly, it is an object of the present invention to provide an improved anchoring device for umbrellas. The anchoring device in accordance with the present invention will allow for an ergonomical usage to facilitate the insertion of the anchoring device into the ground.

The anchoring device in accordance with the present invention is adapted to provide an improved lateral support for the umbrella.

The anchoring device in accordance with the present invention is particularly adapted to conform to conventional forms of manufacturing, be of simple construction and easy to use, as to provide an anchoring device that will be economically feasible, long lasting and relatively trouble-free in operation.

In accordance with an embodiment of the present invention, there is provided an anchoring device for anchoring a post into a ground surface, the anchoring device comprising a substantially elongated body defining a body first end and a body second end ,a coupling sleeve extending longitudinally through a portion of the body, the coupling sleeve defining a coupling sleeve channel, the coupling sleeve channel extending from the body first end to a coupling sleeve bottom wall, the coupling sleeve channel having a coupling sleeve peripheral wall, the coupling sleeve peripheral wall having a coupling sleeve peripheral wall inner surface and a coupling sleeve peripheral wall outer surface; an insertion section extending integrally from the coupling sleeve bottom wall, the insertion section having a substantially conically tapering configuration, the insertion section having an insertion section outer surface; a locking sleeve extending integrally from the coupling sleeve peripheral wall outer surface adjacent the body first end, the locking sleeve having a locking sleeve channel extending therethrough, the locking sleeve channel emerging into the coupling sleeve channel, the locking sleeve channel and the coupling sleeve channel being in a substantially perpendicular relationship relatively to one another, the locking sleeve channel being provided with a locking sleeve channel screwthread; a handle sleeve extending integrally from the coupling sleeve peripheral wall outer surface adjacent the body first end, the handle sleeve having a handle sleeve channel extending therethrough, the handle sleeve channel emerging into the coupling sleeve channel, the handle sleeve channel and the coupling sleeve channel being in a substantially perpendicular relationship relatively to one another; an insertion thread means for allowing the anchoring device to be threadably inserted into the ground surface, the insertion thread means extending integrally from the insertion section outer surface and from at least a segment of the coupling sleeve peripheral wall outer surface.

Conveniently, the locking sleeve and the handle sleeve are in a substantially diametrically opposed relationship relatively to one another.

Preferrably, the anchoring device further includes a reinforcement ring extending integrally from the coupling sleeve peripheral wall outer surface between the locking sleeve and the handle sleeve.

Conveniently, the insertion thread means is a pair of parallel threads.

Preferrably, the insertion thread means extends from the body second end to an insertion thread initial location located intermediate the body first end and the insertion section, the insertion thread initial location being spaced from the locking sleeve and the handle sleeve by a distance that corresponds substantially to the width of a human hand.

Preferrably, the handle sleeve channel has a handle sleeve channel diameter and the locking sleeve channel has a locking sleeve channel diameter, the handle sleeve channel diameter being slightly larger then the locking sleeve diameter.

In a prefered embodiment, the ancoring device further comprises a locking-handle component, the locking-handle component having a substantially "L"-shaped general configuration, the locking-handle component having a first substantially rectilinear segment extending integrally into a substantially bended elbow segment which in turn extends integrally into a second substantially rectilinear segment, the first substantially rectilinear segment being provided with an outwardly extending locking-handle component thread, the first rectilinear segment being slidably insertable into the handle sleeve channel and threadably insertable into the locking sleeve channel.

BRIEF DESCRIPTION OF THE DRAWINGS

An embodiment of the present invention will now be described, by way of example, in reference to the following drawings in which.

DETAILED DESCRIPTION

Figure 1:
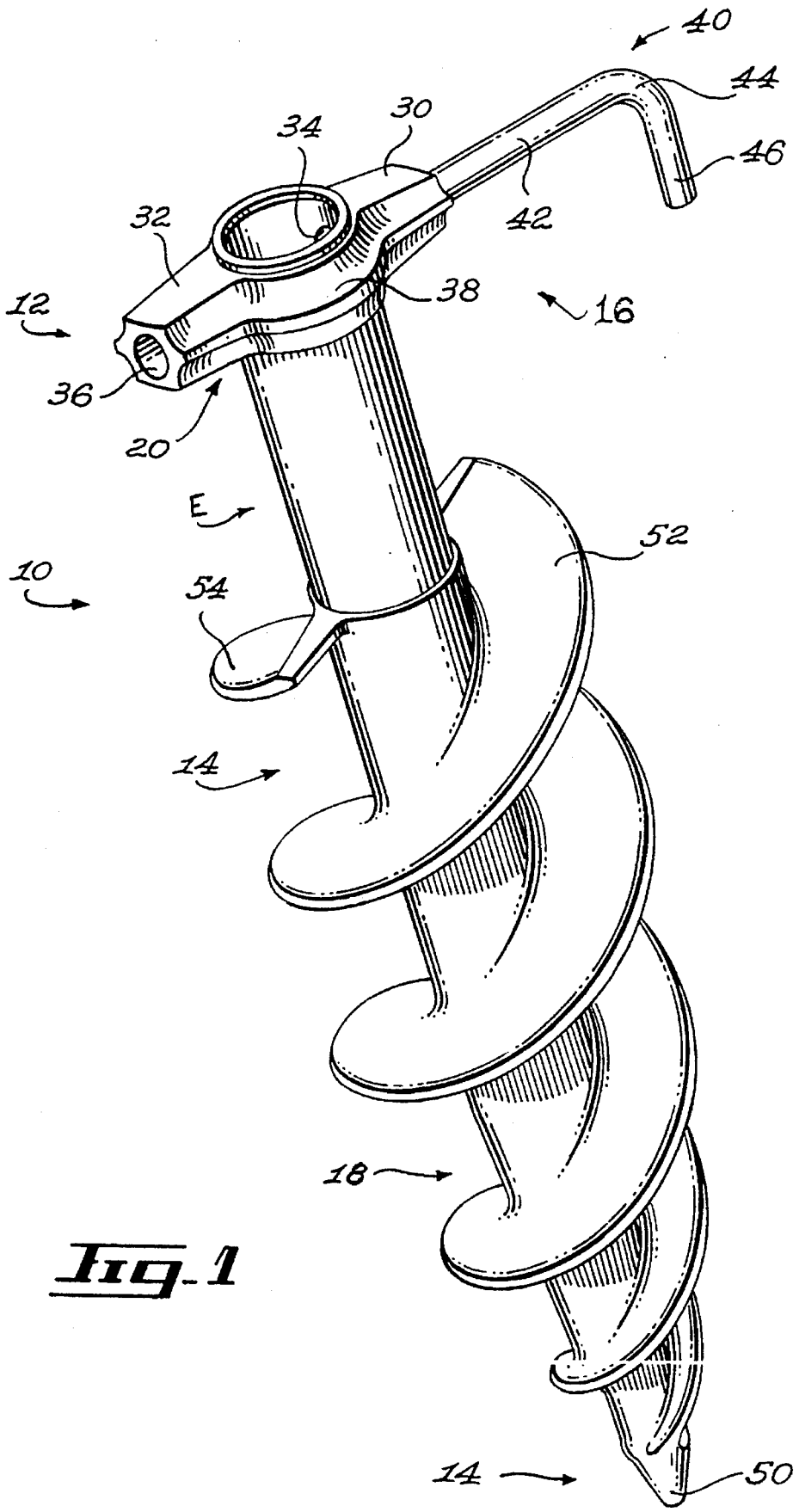
FIG. 1: in a perspective view, illustrates an anchoring device in accordance with an embodiment of the present invention.

Referring to FIG. 1, there is shown an anchoring device 10 in accordance with an embodiment of the present invention. The anchoring device 10 has a substantially elongated general configuration defining a first longitudinal end 12 and a second longitudinal end 14. A coupling section 16 and an integrally extending insertion section 18 are both positioned intermediate the first longitudinal end 12 and the second longitudinal end 14.

Figure 3:
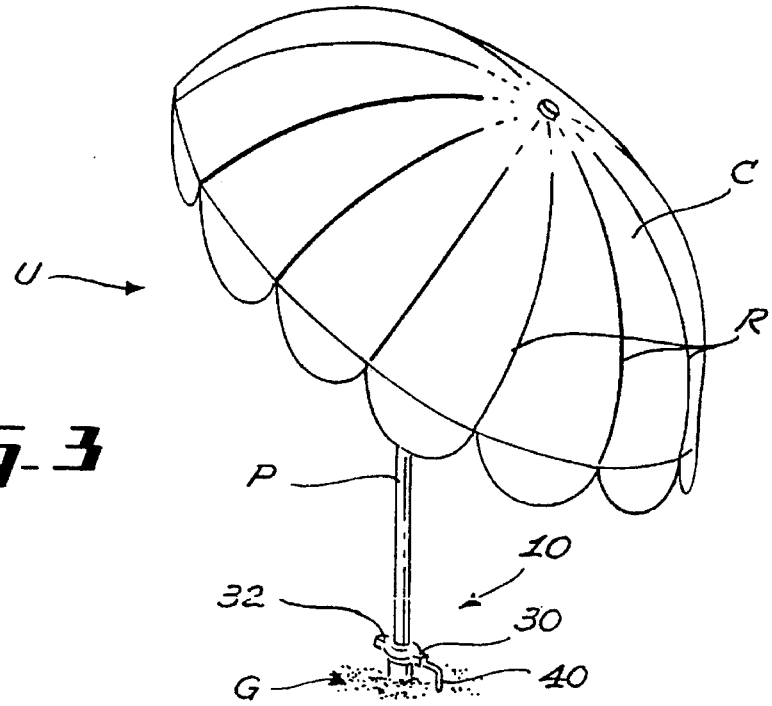
FIG. 3: in a perspective view, illustrates an anchoring device in accordance with an embodiment of the present invention inserted into the ground and supporting a conventional beach umbrella.
Figure 4:
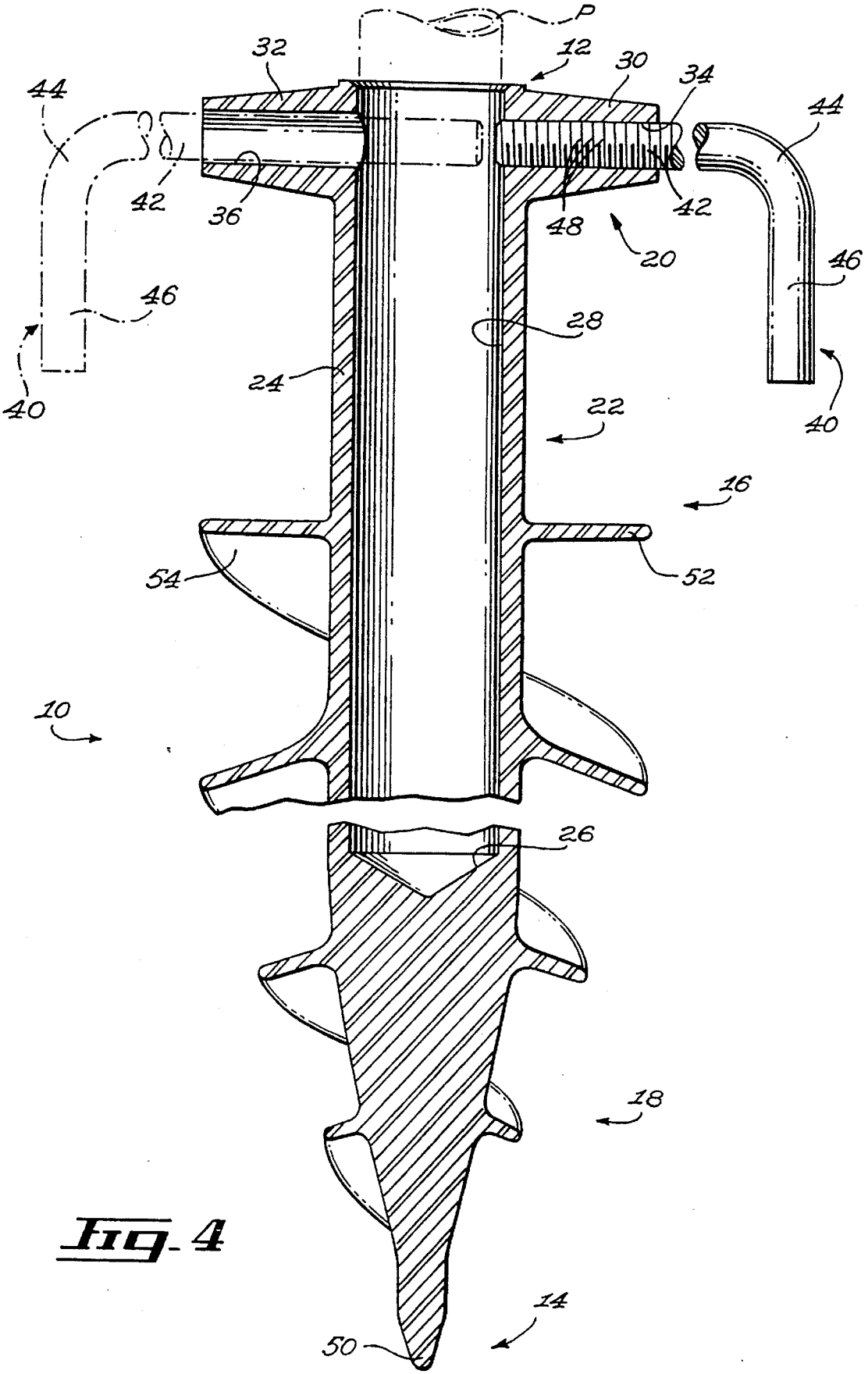
FIG. 4: in a longitudinal cross-sectional view, illustrates a beach umbrella post in accordance with an embodiment of the present invention.

As illustrated more specifically in FIG. 4, the coupling section 16 includes a coupling sleeve 22 and a locking component 20. The coupling sleeve 22 has an open top substantially cylindrical general configuration. The coupling sleeve 22 has a coupling sleeve peripheral wall 24 and a coupling sleeve bottom wall 26. The coupling sleeve peripheral wall 24 extends from the first longitudinal end 12 to the bottom wall 26. The coupling sleeve 22 defines an open top coupling sleeve channel 28. The coupling sleeve channel 28 is adapted to slidably receive an upper post section P part of a conventional umbrella U, such as the one illustrated in FIG. 3.

The locking component 20 is positioned adjacent the first longitudinal end 12. The locking component 20 includes a locking sleeve 30 and a handle receiving sleeve 32. The locking sleeve 30 extends integrally and substantially perpendicularly from the outer surface of the coupling sleeve peripheral wall 24. The locking sleeve 30 has a locking sleeve channel 34 extending therethrough. The locking sleeve channel 34 emerges into the coupling sleeve channel 28. The locking sleeve channel 34 is in a substantially perpendicular relationship with the coupling sleeve channel 28.

The locking sleeve channel 34 is provided with a set of locking channel screw-threads. The locking sleeve channel 34 is adapted to threadably receive a bolt-like component. The bolt-like component is adapted to lockingly abut against a post P inserted into the coupling sleeve channel 28 for frictionnally and reversibly locking the post P inside the coupling sleeve channel 28.

The handle receiving sleeve 32 also extends integrally and substantially perpendicularly from the outer surface of the coupling sleeve peripheral wall 24. The handle receiving sleeve 32 is preferably positioned in a diametrically opposed relationship relatively to the locking sleeve 30. The handle receiving sleeve 32 has a handle receiving sleeve channel 36 extending therethrough. The handle receiving sleeve channel 36 emerges into the coupling sleeve channel 28. The handle receiving sleeve channel 36 is in a substantially perpendicular relationship with the coupling sleeve channel 28.

The handle receiving sleeve channel 36 is adapted to slidably receive a handle-like component that can be grasped by the user when the anchoring device 10 is being inserted into the ground. The handle receiving sleeve channel 36 has a diameter that preferably slightly exceeds the diameter of the locking sleeve channel 34. A reinforcement ring 38 preferably extends integrally from the outer surface of the coupling sleeve peripheral wall 24 in between the locking sleeve 30 and a handle receiving sleeve 32.

The anchoring device 10 preferably includes a locking-handle component 40. The locking-handle component 40 has a substantially "L"-shaped general configuration. The locking-handle component 40 has a first rectilinear segment 42 that extends integrally into a substantially bent elbow segment 44 which in turn extends integrally into a second rectilinear segment 46. The first rectilinear segment 42 is typically longer then the second rectilinear segment 46. The distal end of the first rectilinear segment 42 positioned opposite the elbow segment 44 is provided with a set of external locking-handle component screw threads 48 over a distance that exceeds slightly the length of the locking sleeve channel 34.

The insertion section 18 extends integrally from the lower peripheral edge of the coupling sleeve peripheral wall 24 and from the coupling sleeve bottom wall 26. The insertion section 18 has a substantially conical general configuration that terminates into a point 50 at its apex.

A pair of insertion threads 52 and 54 extend integrally from the outer surface of both the coupling section 16 and the insertion section 18. The insertion threads 52 and 54 both extend from a thread initial position located intermediate the first longitudinal end 12 and the second longitudinal end 14 to a thread final position located adjacent the second longitudinal end 14. A grasping section E extends on the outer surface of the coupling sleeve peripheral wall 24 between the locking component 20 and the thread initial position. The grasping section is preferably sized to allow its grasping by a typical human hand.

In use, as illustrated in FIG. 3, the anchoring device 10 is adapted to anchor a conventional beach umbrella U into the ground G. Typically, the anchoring device 10 is adapted to anchor the umbrella U into a substantially granular material such as a volume of sand or the like. The umbrella includes a main post P on which is collapsibly mounted a canopy C attached to a set of ribs R.

The anchoring device 10 is preferably inserted into the ground G by a screwing operation. In order to facilitate the screwing of the anchoring device 10 into the ground G, the first rectilinear segment 42 of the locking-handle component 40 is first inserted into the handle receiving sleeve channel 36. The handle receiving sleeve channel 36 is sized to allow the first rectilinear segment 42 to be slidably inserted into the latter.

Figure 2:
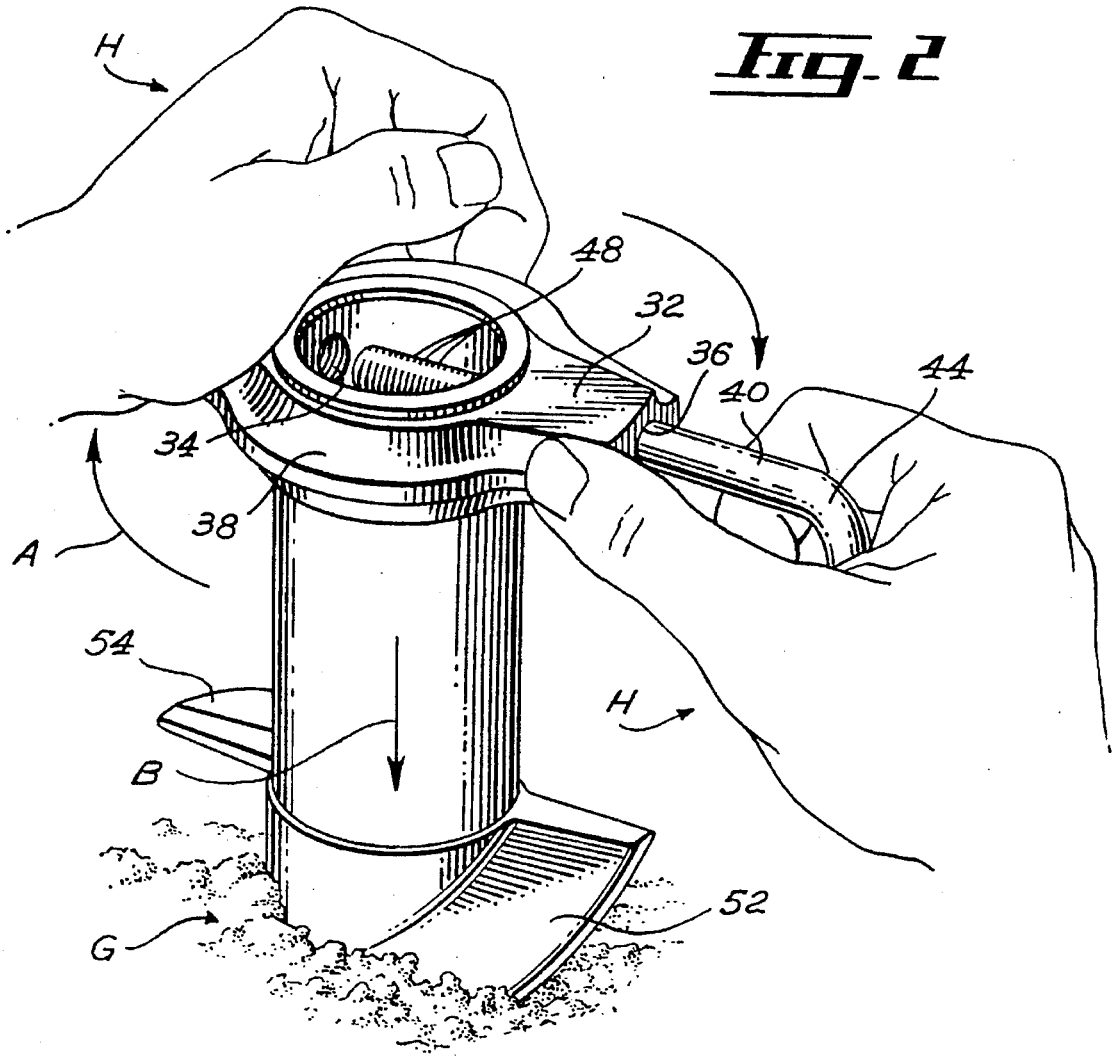
FIG. 2: in a perspective view, illustrates an anchoring device in accordance with an embodiment of the present invention being threadably inserted into the ground.

As illustrated in phantom lines in the left section of FIG. 4 and in FIG. 2, once the first rectilinear segment 42 is inserted into the handle receiving sleeve channel 36, it is adapted to act as a handle that facilitates the rotation of the anchoring device 10 about its longitudinal axis. The rotation of the anchoring device is schematically indicated in FIG. 2 by the arrows A while the resulting penetration of the anchoring device 10 in the ground G is schematically indicated by the arrow B.

Not only does the locking-handle component 40 allow for a good grip, as illustrated in FIG. 2, but it also increases the distance between the force applied by the user and the rotation axis and thus increases the effective torque transmitted to the anchoring device 10 by the hands H of the user. During the initial movements of the screwing action, the user might wish to stabilize the anchoring device 10 by grasping the grasping section E while using the locking-handle component 40 to exert a torque.

At a later stage of the screwing action, when the torque resistance increases due to the penetration of the insertion section 18 into the ground G, the user may wish to add additional torque by pushing unto the locking sleeve 30 while pulling unto the locking-handle component 40 as illustrated in FIG. 2. Typically, the anchoring device is threadably inserted into the ground until the ground surface reaches the thread initial position.

One of the main features of the present invention resides in the use of a pair of parallel insertion threads 52 and 54 instead of a single thread. The use of parallel threads 52 and 54 not only facilitates the insertion of the anchoring device 10 into the ground 10 but it also increases the stability of the anchoring device 10 once it is inserted into the ground G.

Once the anchoring device 10 is properly inserted into the ground G, the first rectilinear segment 42 is slidably removed from the handle receiving sleeve channel 36 and the lower end portion of the umbrella post P is slidably inserted into the coupling sleeve channel 28.

Another main feature of the present invention resides in the fact that once the umbrella post P is inserted into the coupling sleeve channel 28, the same locking-handle component 40 that was used as a handle can now be used to releasably lock the umbrella post P into the coupling sleeve channel 28.

To lock the lower end section of the umbrella post into the coupling sleeve channel 28, the distal threaded end of the first rectilinear segment 42 is threadably inserted into the locking sleeve channel 34 until it abuttingly contacts the outer surface of the umbrella post P, as illustrated in the right side of FIG. 4. The rotation of the first rectilinear segment 42 in the locking sleeve channel 34 is facilitated by the presence of the second rectilinear segment 46 that can easily be grasp by the user.

Once the distal end of the first rectilinear segment 42 abuttingly contacts the outer surface of the umbrella post P the contact is tightened to frictionnally lock the lower end section of the umbrella post into the coupling sleeve channel 28. When the umbrella U and tile anchoring device 10 need to be removed, the hereinbefore mentioned steps merely need to be reversed.

The embodiments of the invention in which an exclusive privilege or property is claimed are defined as follows:

1. An anchoring device for anchoring a post into a ground surface, said anchoring device comprising:

a substantially elongated body defining a body first end and a body second end, a coupling sleeve extending longitudinally through a portion of said body, said coupling sleeve defining a coupling sleeve channel, said coupling sleeve channel extending from said body first end to a coupling sleeve bottom wall, said coupling sleeve channel having a coupling sleeve peripheral wall, said coupling sleeve peripheral wall having a coupling sleeve peripheral wall inner surface and a coupling sleeve peripheral wall outer surface;

an insertion section extending integrally from said coupling sleeve bottom wall, said insertion section having a substantially conically tapering configuration, said insertion section having an insertion section outer surface;

a locking sleeve extending integrally from said coupling sleeve peripheral wall outer surface adjacent said body first end, said locking sleeve having a locking sleeve channel extending therethrough, said locking sleeve channel emerging into said coupling sleeve channel, said locking sleeve channel and said coupling sleeve channel being in a substantially perpendicular relationship relatively to one another, said locking sleeve channel being provided with a locking sleeve channel screw-thread;

a handle sleeve extending integrally from said coupling sleeve peripheral wall outer surface adjacent said body first end, said handle sleeve having a handle sleeve channel extending therethrough, said handle sleeve channel emerging into said coupling sleeve channel, said handle sleeve channel and said coupling sleeve channel being in a substantially perpendicular relationship relatively to one another;

an insertion thread means for allowing said anchoring device to be threadably inserted into said ground surface, said insertion thread means extending integrally from said insertion section outer surface and from at least a segment of said coupling sleeve peripheral wall outer surface.

2. An anchoring device as recited in claim 1 wherein said locking sleeve and said handle sleeve are in a substantially diametrically opposed relationship relatively to one another.

3. An anchoring device as recited in claim 2 wherein said anchoring device further includes a reinforcement ring extending integrally from said coupling sleeve peripheral wall outer surface between said locking sleeve and said handle sleeve.

4. An anchoring device as recited in claim 1, wherein said insertion thread means is a pair of parallel threads.

5. An anchoring device as recited in claim 1 wherein said insertion thread means extends from said body second end to an insertion thread initial location located intermediate said body first end and said insertion section, said insertion thread initial location being spaced from said locking sleeve and said handle sleeve by a distance that corresponds substantially to the width of a human hand.

6. An anchoring device as recited in claim 1 wherein said handle sleeve channel has a handle sleeve channel diameter and said locking sleeve channel has a locking sleeve channel diameter, said handle sleeve channel diameter being slightly larger then said locking sleeve diameter.

7. An anchoring device as recited in claim 1 further comprising a locking-handle component, said locking-handle component having a substantially "L"-shaped general configuration, said locking-handle component having a first substantially rectilinear segment extending integrally into a substantially bended elbow segment which in turn extends integrally into a second substantially rectilinear segment, said first substantially rectilinear segment being provided with an outwardly extending locking-handle component thread, said first rectilinear segment being slidably insertable into said handle sleeve channel and threadably insertable into said locking sleeve channel.

* * * * *